United States Patent [19]

Jeang

[11] Patent Number: 4,671,088

[45] Date of Patent: Jun. 9, 1987

[54] COMBINED COMBINATION AND KEY-TYPE LOCK

[75] Inventor: Yuh Y. Jeang, Chang Hua, Taiwan

[73] Assignee: Yan Chan Hong, Chang Hua, Taiwan

[21] Appl. No.: 698,818

[22] Filed: Feb. 6, 1985

[51] Int. Cl.[4] ..... E05B 37/02

[52] U.S. Cl. ..... 70/312; 70/284; 70/316

[58] Field of Search ..... 70/284, 312, 316, 21, 70/285, 315–317, 318, 287, 288

[56] References Cited

U.S. PATENT DOCUMENTS

| | | | |
|---|---|---|---|
| 3,555,860 | 1/1971 | Atkinson | 292/42 |
| 3,633,388 | 1/1972 | Atkinson | 70/312 X |
| 3,695,072 | 10/1972 | Milette | 70/312 |
| 3,942,344 | 3/1976 | Gehrie et al. | 70/312 |
| 4,327,566 | 5/1982 | Ling | 70/312 |
| 4,341,101 | 7/1982 | Bako | 70/312 |
| 4,343,165 | 8/1982 | Bako | 70/312 |
| 4,366,685 | 1/1983 | Remington | 70/312 |
| 4,520,641 | 6/1985 | Bako | 70/312 |
| 4,557,122 | 12/1985 | Hwang | 70/284 |

*Primary Examiner*—Gary L. Smith
*Assistant Examiner*—Vinh Luong
*Attorney, Agent, or Firm*—Antonelli, Terry & Wands

[57] ABSTRACT

A lock includes three main elements, i.e. an actuating plate, a plurality of numbered wheels and a lock body wherein the actuating plate has a second engaging medium which is engagable with a first engaging medium, which is provided on a case desired to be provided with the present lock so that when the first and second media interengage the case is kept locked, and the numbered wheels and/or the lock body can engage with the actuating plate to enable the engagement between the first and second engaging media.

1 Claim, 9 Drawing Figures

COMBINED COMBINATION AND KEY-TYPE LOCK

BACKGROUND OF THE INVENTION

The present invention relates to a lock, and more particularly to a lock having an actuating plate.

Numerical locks having an actuating plate are frequently adopted by the suitcase or baggage manufacturer because they have a simple structure and are inexpensive. However, often these simple locks are not capable of providing reliable security, as is known in this field. In addition, the numerals on the numerical wheels of many such locks are so small that it is impossible for an elderly person to see the correct numerals which unlock the case. There is a numerical lock having duplicate locking function, however, it does not incorporate thereon an actuating plate and has a complicated structure and a high manufacturing cost and cannot be assembled easily. It is therefore attempted by the applicant to deal with the above situation encountered by the prior art.

SUMMARY OF THE INVENTION

It is therefore an object of the present invention to provide a lock capable of being governed in a locked position by a plurality of numbered wheels and/or a lock body.

According to the present invention, a lock includes a housing adapted to be disposed on a baggage case which is provided with a first engaging medium, an actuating plate having its one side kept pivotally mounted on the housing and having a second engaging medium which when the actuating plate is pivoted down engages with the first engaging medium to secure the baggage case by the lock, an elastic member, mounted between the actuating plate and the housing, for ensuring that when the force pivoting down the actuating plate is removed the actuating plate will return to its original position, a shaft kept fixed right above the actuating plate on the housing, a plurality of numbered wheels each of which has a hollow central portion, a plurality of intermediate pieces each of which is rotatably mounted on the shaft, and is fixedly engaged with the hollow central portion and has a flanged cam which includes a first cam surface being a circular surface capable of engaging with and pivoting down the actuating plate and a second cam surface being a flat surface capable of engaging with but not pivoting down the actuating plate, a lock seat securely mounted on the housing, a lock body received in the lock seat, having a key hole at the top thereof and having at the bottom thereof an uneven surface which includes a first surface capable of engaging with and pivoting down the actuating plate to enable the engagement between the first and second engaging media and a second surface capable of freeing the actuating plate from its down position, and at least one piece of tumbler cooperating with the lock seat and body so that the lock body can rotate in the lock seat when a suitable key is inserted into the key hole so that the present lock can be unlocked only when all of the second cam surfaces of the intermediate pieces engage with the actuating plate and the second surface is free from pivoting down the actuating plate.

Certainly, the lock seat can be integrally formed with the housing.

Preferably the actuating plate further includes a plurality of spaced holes along the one side and a protruding arm on one end for being engaged with the lock, with each of the numbered wheels protruding from one of the spaced holes.

Preferably the present lock further includes a plurality of plate springs each of which is provided at a place right beneath one of the numbered wheels to urge against the one numbered wheel and is curved up from a plate mounted between the numbered wheels and the bottom of the housing.

Preferably the first engaging medium is a part of the present lock in which the second engaging medium is formed on a side opposite to the one side and includes two downwardly curved spaced protrusions, while the first engaging medium includes two engaging pieces each of which is securely attached to one of the two halves of a baggage case which together constitute the whole baggage case, and each of which has an engaging hole that is capable of securely engaging with one of the protrusions on the second engaging medium when the actuating plate is pivoted down.

Alternatively, the first engaging medium can also be a part of the present lock in which the housing is securely attached to one half of a baggage case, the second engaging medium is formed on a side opposite to the one side and includes two spaced protrusions, while the first engaging medium is securely attached to the other half of the case, which together with the one half constitute the whole baggage case, and includes two corresponding protrusions each of which is capable of securely engaging with one of the spaced protrusions when the actuating plate is pivoted down.

The present invention may best be understood with reference to the accompanying drawings, in which:

DETAILED DESCRIPTION OF THE PREFERRED EMBODIMENT

Figure 1:
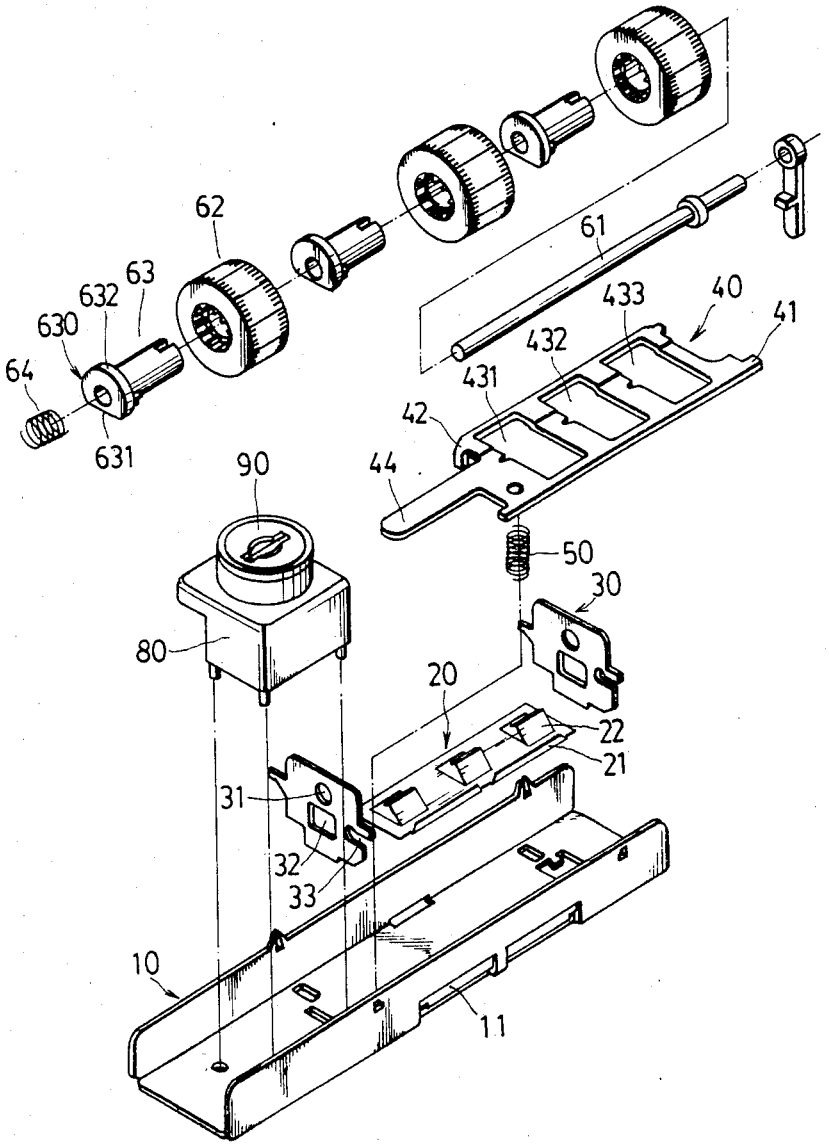
FIG. 1 is an exploded view of a lock according to the present invention.
Figure 2:
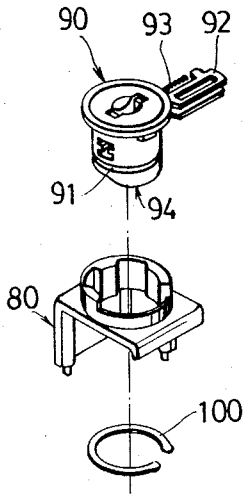
FIG. 2 is an exploded view showing the engagement of a lock seat and a lock body of a lock according to the present invention.
Figure 8:
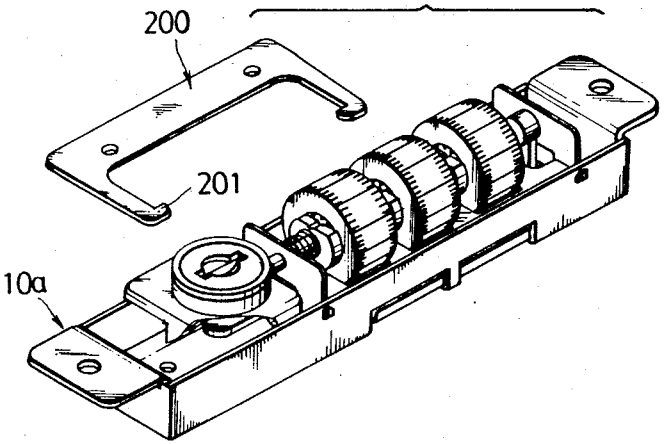
FIG. 8 is a perspective view showing further a preferred embodiment of a lock according to the present invention.
Figure 3:
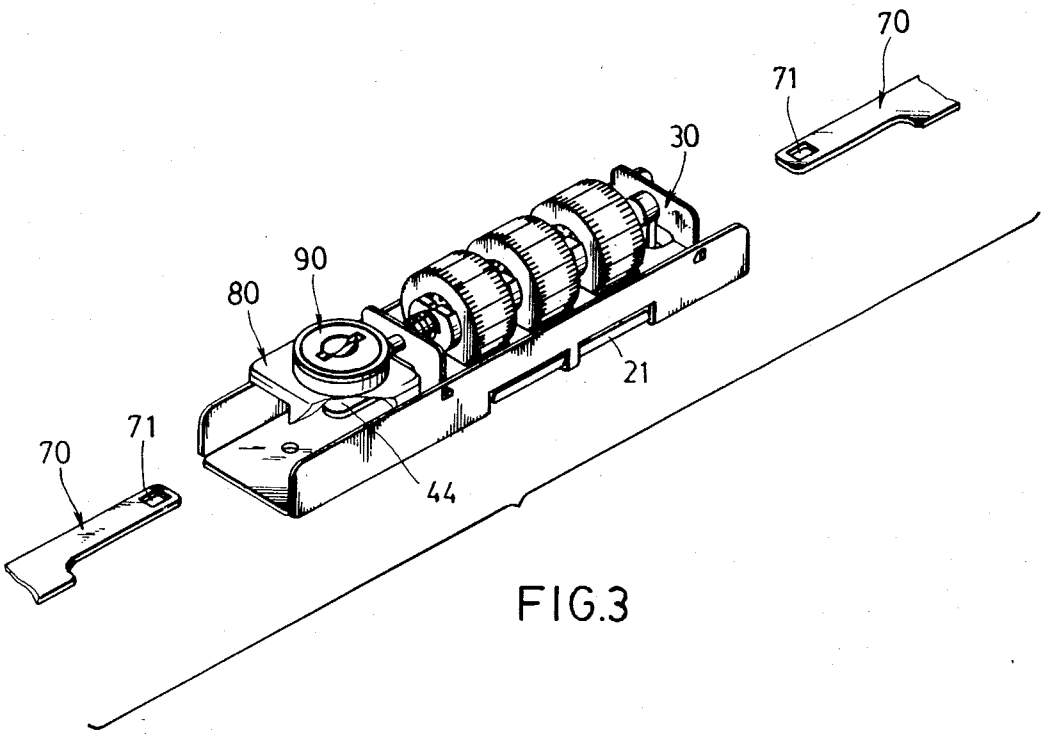
FIG. 3 is a perspective view showing an assembled lock according to the present invention.
Figure 5:
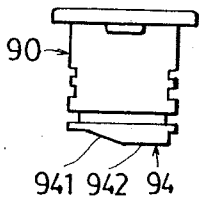
FIG. 5 is a side view showing a lock body of a lock according to the present invention.
Figure 4:
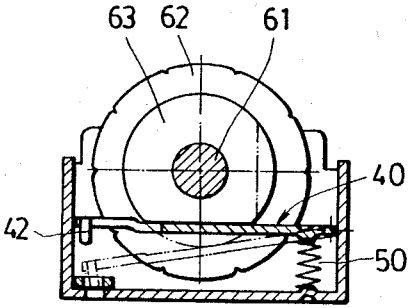
FIG. 4 is a sectional view showing how an intermediate piece engages with an actuating plate of a lock according to the present invention.
Figure 6B:
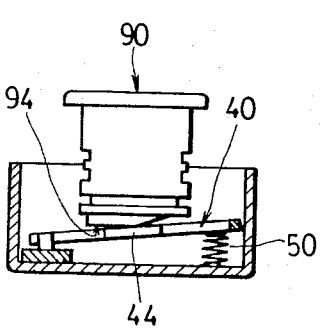
FIG. 6B is a sectional view showing how a first surface of a lock body engages with and pivots down an actuating plate of a lock according to the present invention.
Figure 6A:
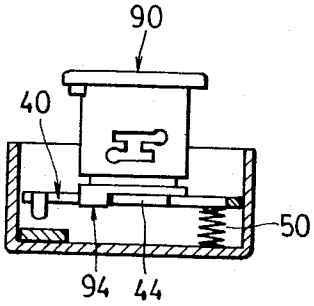
FIG. 6A is a sectional view showing how a second surface of a lock body frees from pivoting down an actuating plate of a lock of the present invention.
Figure 7:
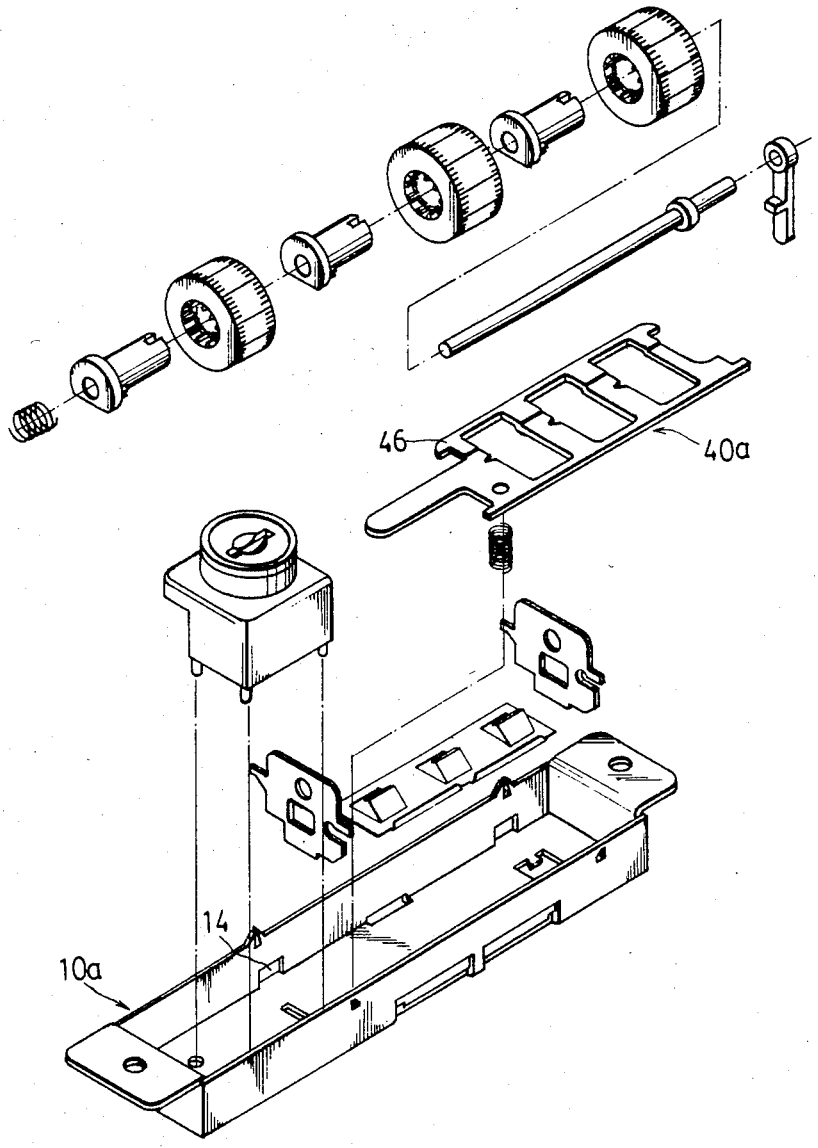
FIG. 7 is an exploded view showing further a preferred embodiment of a lock according to the present invention.

Referring now to FIGS. 1–3, a lock according to the present invention includes a housing 10, an actuating plate 40, an elastic member 50, a shaft 61, a plurality of numbered wheels 62, a plurality of intermediate pieces 63, a lock 80, a lock body 90 and a plurality of pieces of tumblers 92. Housing 10 is to be disposed or secured on a case to be locked and has two slits 11 and the case is provided with a first engaging medium 70 which has a hole 71. Actuating plate 40 has its one side 41 kept pivotally mounted on two slots 33 respectively possessed by two securing pieces 30 which are held securely attached to housing 10 and each of which further includes a shaft hole 31 through which shaft 61 can pass and a square hole 32 from which a protruding arm 44 of actuating plate 40 can protrude. Actuating plate 40 further includes three spaced holes 431, 432, 433 along side 41 and a second engaging medium 42 which engages with first engaging medium 70 at holes 71 to secure the case locked by the present lock when actuating plate 40 is pivoted down. Elastic member 50 is mounted between actuating plate 40 and housing 10 for ensuring that actuating plate 40 returns to its original position when the force pivoting down actuating plate 40 is removed. Shaft 61 is kept fixed right above actuating plate 40 on housing 10. Each of numbered wheels 62 protrudes in one of holes 431–433 and has a hollow central portion. Each of intermediate pieces 63 is rotatably mounted on shaft 61, and fixedly engages with the hollow central portion of each wheel 62 and has a flanged cam 630 which, as is shown in FIGS. 1 & 4, has a first cam surface 632 being a circular surface capable of engaging with and pivoting down actuating plate 40 and a second cam surface 631 being a flat surface capable of engaging with but not pivoting down actuating plate 40. Lock seat 80 is securely mounted on housing 10. Lock body 90 is securely received in lock seat 80 by a retaining collar 100 retained in an annular groove 91 provided at the lower portion of lock body 90 after lock body 90 is inserted into lock seat 80, has a key hole at the top thereof and has at the bottom thereof an uneven cam surface 94 which, as complementarily shown in FIGS. 5–6B, includes a first surface 942 capable of engaging with and pivoting down protruding arm 44 to enable the engagement between first and second media 70 and 42 and a second surface 941 capable of releasing protruding arm 44 after it has been pivoted down. Tumblers 92 and a spring 93 cooperate with lock seat 80 and body 90 so that lock body 90 can rotate in lock seat 80 when a suitable key is inserted into the key hole. Through the above mechanism, the present lock can be unlocked only when all of second cam surfaces 631 of intermediate pieces 63 engage with actuating plate 40 and second surface 941 is free from pivoting down protruding arm 44. For tightness of numbered wheels 62, there is provided a plate 20 which is mounted between numbered wheels 62 and the bottom of housing 10 and has two bent protrusions 21 capable of fitting against slits 11 respectively and from which three plate springs 22 are curved up and are provided at places right beneath numbered wheels 62 to urge against numbered wheels 62 respectively and a spring 64 which is mounted on shaft 61 between a securing piece 30 and an intermediate piece 63. In FIGS. 7 & 8, there is shown another preferred embodiment of the present lock which differs from the lock as described with reference to FIGS. 1–6B in housing 10*a*, first engaging medium 200 and second engaging medium 46 of corresponding actuating plate 40*a*. Second engaging medium 46 engages with a hook-like protrusion 201 of first engaging medium 200 which protrudes in housing 10*a* from a hole 14 of housing 10*a*. It is reasonable to assume that the lock seat 80 can be integrally formed with housing 10(10*a*).

While the present invention has been described in connection with what is presently considered to be the most practical and preferred embodiment, it is to be understood that the invention is not to be limited to the disclosed embodiment but on the contrary, is intended to cover various modifications and equivalent arrangements included within the spirit and scope of the appended claims which scope is to be accorded the broadest interpretation so as to encompass all such modifications and equivalent structures.

What I claim is:

1. A lock comprising a base housing channel piece, two transverse upright securing pieces mounted in said channel piece, an actuating plate having two opposite ends which are mounted pivotally on said securing pieces and having an engaging medium that can be placed in a locking position when said actuating plate is pivoted downward, an elastic member mounted between said actuating plate and said housing for normally urging said actuating plate so as to place said engaging medium in an unlocking position, a shaft mounted on said securing pieces above said actuating plate, a plurality of intermediate sleeve pieces rotatably mounted on said shaft and capable of camming said actuating plate to move between a locking position and an unlocking position, a plurality of numbered wheels mounted respectively on said intermediate sleeve pieces, a key-operated lock seat provided in said housing adjacent to one of said securing pieces, a key-operated lock body inserted rotatably in said lock seat and incorporating a tumbler means, wherein said actuating plate has a protruding arm extending through an opening of said adjacent securing piece to below a bottom side of said lock body, and said lock body has a bottom cam surface to cam said protruding arm so as to place said actuating plate in a locking position or an unlocking position.

* * * * *